US007264440B2

(12) United States Patent
Ikeya

(10) Patent No.: US 7,264,440 B2
(45) Date of Patent: Sep. 4, 2007

(54) FUEL PUMP

(75) Inventor: Masaki Ikeya, Obu (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 527 days.

(21) Appl. No.: 10/851,732

(22) Filed: May 20, 2004

(65) Prior Publication Data

US 2004/0247468 A1 Dec. 9, 2004

(30) Foreign Application Priority Data

Jun. 6, 2003 (JP) ..... 2003-162785

(51) Int. Cl.
*F01D 1/12* (2006.01)

(52) U.S. Cl. ..... 415/55.5

(58) Field of Classification Search ..... 415/55.1, 415/55.5, 55.6

See application file for complete search history.

(56) References Cited

U.S. PATENT DOCUMENTS 6,309,173 B1 * 10/2001 Marx ..... 415/55.1
6,464,450 B1 * 10/2002 Fischer ..... 415/55.1
6,638,009 B2 * 10/2003 Honma ..... 415/55.1
6,733,230 B2 * 5/2004 Miura et al. ..... 415/55.1
2004/0136823 A1 * 7/2004 Baek et al. ..... 415/55.1

FOREIGN PATENT DOCUMENTS

| | | |
|---|---|---|
| EP | 89 11 302.0 | 1/1991 |
| EP | 197 44 037 | 1/1991 |
| JP | 01-177492 | 7/1989 |
| WO | WO99/07990 | 2/1989 |

OTHER PUBLICATIONS

U.S. Appl. No. 10/808,638, unpublished Aisan Ind C Ltd.

* cited by examiner

*Primary Examiner*—Edward K. Look
*Assistant Examiner*—Nathan Wiehe
(74) *Attorney, Agent, or Firm*—Dennison, Schultz & MacDonald

(57) ABSTRACT

A fuel pump in which fuel can pass smoothly through through-holes of an impeller is taught. Through-holes communicate concavities formed in upper and lower faces of the impeller. These through-holes are formed at an inner side region within the concavities. When the impeller rotates, the rotational speed of the portion provided with the through-holes is slower than in the case where these through-holes are formed at the outer side region within the concavities. As a result, the fuel in the vicinity of the through-holes within the concavity has a slower rotational speed, and consequently the fuel passes easily through the through-holes.

6 Claims, 7 Drawing Sheets

FUEL PUMP

CROSS-REFERENCE

The present application claims priority based on Japanese Patent Application 2003-162785 filed on Jun. 6, 2003. The specification and figures of that Japanese application are hereby incorporated by reference within the specification and figures of the present application.

FIELD OF THE INVENTION

The present invention relates to a fuel pump for drawing in a fuel such as gasoline etc., increasing the pressure thereof, and discharging the pressurized fuel.

BACKGROUND OF THE INVENTION

As disclosed in PCT International Publication WO99-07990, a fuel pump is provided with a substantially disc-shaped impeller that rotates within a casing. As shown in FIG. 9, a group of concavities 36*a* is formed in an upper face of the impeller 36, and the group of concavities 36*a* is formed along the circumference direction of the impeller 36 in an area located inwardly from an outer circumference 36*d* of the impeller 36 by a distance shown by "A" in FIG. 9. Each of concavities 36*a* extends in the radial direction by a distance shown by "B" in FIG. 9. The concavities 36*a* are repeated in the circumference direction, and adjacent concavities 36*a*, 36*a* are separated by a partitioning wall 36*b*. As shown in FIG. 11, a group of concavities 36*e* having the same configurations as the group of concavities 36*a* is formed in an lower face of the impeller 36

As shown in FIGS. 10 and 11, bottom portions of the pair of upper concavity 36*a* and lower concavity 36*e* are communicated with each other at the outer side region within the concavities 36*a*, 36*e*. The length of a through-hole 36*c* communicating the pair of upper concavity 36*a* and lower concavity 36*e* in the radial direction is shown as "C" in FIGS. 10 and 11. The distance "C" is formed within the distance "B" at the outer side.

A pair of grooves is formed at interior faces of the casing that houses the impeller 36, each groove being formed in an area directly facing each of the groups of concavities 36*a*, 36*e* and extending continuously in the direction of rotation of the impeller 36 from an upper flow end to a lower flow end. An intake hole passes through the casing to the upper flow end, and a discharge hole passes through the casing from the lower flow end.

When the impeller 36 rotates within the casing, fuel is drawn into the casing from the intake hole, is pressurized as it flows along the circumference direction within the casing, and then the pressurized fuel is discharged from the discharge hole.

SUMMARY OF THE INVENTION

In a fuel pump utilizing an impeller in which bottom portions of a pair of concavities formed in upper and lower faces of the impeller communicate, it is preferred that the fuel flows smoothly through a through-hole that communicates the pair of upper and lower concavities. When it is difficult for the fuel to pass through the through-hole, some of the fuel that has been drawn into the casing easily vaporizes. When vapor is formed, the pressurizing force by the fuel pump is decreased and the quantity of the fuel discharged from the pump is likely to be insufficient. Since fuel tends to vaporize at high temperatures, serious problems occur if the fuel does not pass smoothly through the through-holes, especially when the fuel is at high temperatures.

The present invention teaches a fuel pump in which fuel can smoothly pass through a through-hole that communicates a pair of upper and lower concavities. The present invention effectively improves the pump performance. Especially, the fuel pump of the present invention prevents the pump performance from decreasing that often occurs at high fuel temperatures.

After carefully examining the conventional impeller shown in FIGS. 9 to 11, the inventors have discovered that the prior art through-hole communicating the pair of upper and lower concavities is not suitably designed for promoting smooth fuel flow. The inventors have found that pump performance can be increased by improving the design of the through-holes. In particular, vaporization of fuel at high temperatures is effectively reduced due to the improvement of the through-holes, and pump performance at high fuel temperatures may be improved.

As shown in FIGS. 10 and 11, in the conventional impeller 36, the through-holes 36*c* are formed at the outer side region within the concavities 36*a*, 36*e*. As shown in FIG. 12, the concavities 36*a*, 36*e* extend for the distance "B" along the radial direction of the impeller 36. Consequently, the rotational speed "E" at an outer side "e" of each concavity 36*a*, 36*e* is greater than the rotational speed "F" at an inner side "f" thereof when the impeller 36 rotates. When the fuel flows into each of the concavities 36*a*, 36*e*, a revolving current of the fuel is created by the rotation of the impeller 36 within each of the concavities 36*a*, 36*e*. The fuel within each of the concavities 36*a*, 36*e* passes, while revolving, through the through-hole 36*c*. It was discovered that, because the prior art through-holes 36*c* are formed at the outer side within the concavities where the fuel has a greater rotational speed than at the inner side within the concavities, it is difficult for the fuel to pass through the through-holes 36*c*.

The present invention has been created on the basis of that finding. According to the invention, through-holes 36*c* are formed at the inner side region within the concavities where the fuel has a slower rotational speed than at the outer side region. The present invention results in that the fuel passes smoothly through the through-holes 36*c* and vaporization of the fuel does not readily occur.

A fuel pump of the present invention is provided with a substantially disc-shaped impeller rotating within a casing. A group of concavities is formed in an upper face of the impeller, and the group of concavities extends along the circumference direction of the impeller within an area located inwardly, in the radial direction, from an outer circumference of the impeller by a first predetermined distance. Each of concavities extends in the radial direction of the impeller for a second predetermined distance. Adjacent concavities are separated by a partitioning wall and the concavities are repeated in the circumference direction. A group of concavities is formed in an lower face of the impeller. The group of lower concavities has the same configuration as of the group of upper concavities.

One feature of the fuel pump of the present invention is that bottom portions of the pair of upper and lower concavities communicate at an inner side region within the concavities.

Another feature of the present invention may also be defined that the bottom portions of the pair of upper and lower concavities do not communicate at an outer side within the concavities.

Alternatively, the fuel pump of the present invention may also be defined that the bottom portions of the pair of upper and lower concavities communicate at the inner side within the concavities and do not communicate at the outer side within the concavities.

In the fuel pump of the present invention, the through-holes communicating the bottom portions of the pair of upper and lower concavities are formed at the inner side region within the concavities. Consequently, the rotational speed at the through-holes is slower than when the through-holes are formed at the outer side within the concavities. By this means, the fuel in the vicinity of the through-holes has a slower rotational speed, and the fuel consequently passes easily through the through-holes. Since the fuel passes smoothly through the through-holes, vapor is not readily formed within the fuel pump. Pump performance at high fuel temperatures, when vapor readily forms, can thus be stabilized.

In the fuel pump of the present invention, the bottom portions of the pair of concavities formed in the upper and lower faces of the impeller are connected along a third distance "C" in the radial direction of the impeller, the third distance "C" preferably being set to be between one quarter to three quarters of the second distance "B". The second distance "B" is the length of each of the concavities along the radial direction of the impeller.

According to the research of the present inventors, by setting the length "C" of the through-holes in the radial direction (16*c*1: see FIG. 3) to be between one quarter to three quarters of the length "B" of the concavities in the radial direction (16*a*1: see FIG. 3), revolving currents of the fuel that has entered the concavities are readily formed, and the necessary size of the through-holes can also be maintained.

In the fuel pump of the present invention, it is preferred that, when viewed cross-sectionally along the radial direction of the impeller, wall faces, which are located at the outer side of the concavities of the impeller and partition the bottom portions of the upper and lower concavities, extend along curved lines that make contact with a central line bisecting the impeller in its thickness.

The revolving currents of fuel that occur in the upper and lower concavities merge at the through-holes. By forming the wall faces, which partition the bottom portions of the upper and lower concavities, such that they make contact with the central face bisecting the impeller in its thickness, the fuel flows along the wall faces of the concavities. Consequently, the upper and lower revolving currents of fuel do not collide at the through-holes of the concavities, but are parallel. By this means, the upper and lower revolving currents of fuel are prevented from colliding at the through-holes, and it is possible to reduce agitation of the currents and the loss of energy caused by the currents of fuel colliding.

In the fuel pump of the present invention, it is preferred that wall faces at the inner side of the concavities incline outwardly towards the bottom portions of the concavities.

The majority of impellers are formed by resin molding which are extracted from a molding die. If the concavities are formed in the above shape, the wall faces formed at the inner side of the concavities can be utilized as slopes that aid in extraction from the molding die (inclinations is required for extracting the resin impeller from the molding die within which it has been molded). When the wall faces at the inner side of the concavities incline outwardly towards the bottom, the production efficiency of the impellers can be improved and the fuel currents within the concavities can revolve smoothly.

In the fuel pump of the present invention, it is preferred that wall faces at the inner side of the concavities are curved faces that incline outwardly towards the bottom portions of the concavities.

When the concavities are formed in this manner, the shape of the wall faces at the inner and outer sides of the concavities allows the currents of fuel to revolve more smoothly.

In the fuel pump of the present invention, it is preferred that, when each of the upper and lower concavities extend for the second distance "B" in the radial direction, the bottom portions of the upper and lower concavities are connected over a region extending from an inner end portion of the concavities by a distance less than one eighth of the second distance "B".

When the through-holes are formed at a very inner side, that is, the distance between the inner end of the concavities and the inner end of the through-hole is less than one eighth of the second distance "B", the fuel that has entered the concavities readily form revolving currents, and the necessary size of the through-holes can also be maintained.

EMBODIMENT OF THE INVENTION

Preferred embodiments of the present invention are described below.

It is preferred that, when viewed cross-sectionally along the radial direction of the impeller, wall faces at the outer side of the concavities, which partition the bottom portions of the upper and lower concavities, extend along curved lines that make contact with a central line bisecting the impeller in its thickness, and it is preferred that the partitioning wall between the upper and lower concavities is cut at a top ridge. The cut top surface forms a flat face which defines a through-hole. The cut top surface extends for a predetermined thickness along the direction of impeller thickness.

When the partitioning walls between the upper and lower concavities are formed such that they make contact with the central plane bisecting the impeller in its thickness, the walls will take on a thin ridge towards the central plane without any limit on the degree of thinness. However, if the walls are formed in this manner, there is the danger that this thin ridge at the central plane may be of uncertain strength and may change its shape, thereby preventing the currents of fuel from revolving smoothly.

When viewed cross-sectionally along the radial direction of the impeller, it is preferable that the wall faces between the upper and lower concavities extend along curved lines that make contact with a central line bisecting the impeller in its thickness and the partitioning wall is truncated to form an flat face at a point where the partitioning wall grows thinner up to a predetermined thickness. The flat face forms a wall face of the through-hole.

When the partitioning walls between the upper and lower concavities are formed in this manner, the formation of parallel fuel flow at the through-holes between the concavities is promoted, and it is possible to reduce agitation of the currents and the loss of energy caused by the currents of fuel colliding. The strength of the partitioning wall can be maintained, and the necessary size of the through-holes can also be maintained. If anything, the fuel passes more easily through the through-holes.

Figure 1:
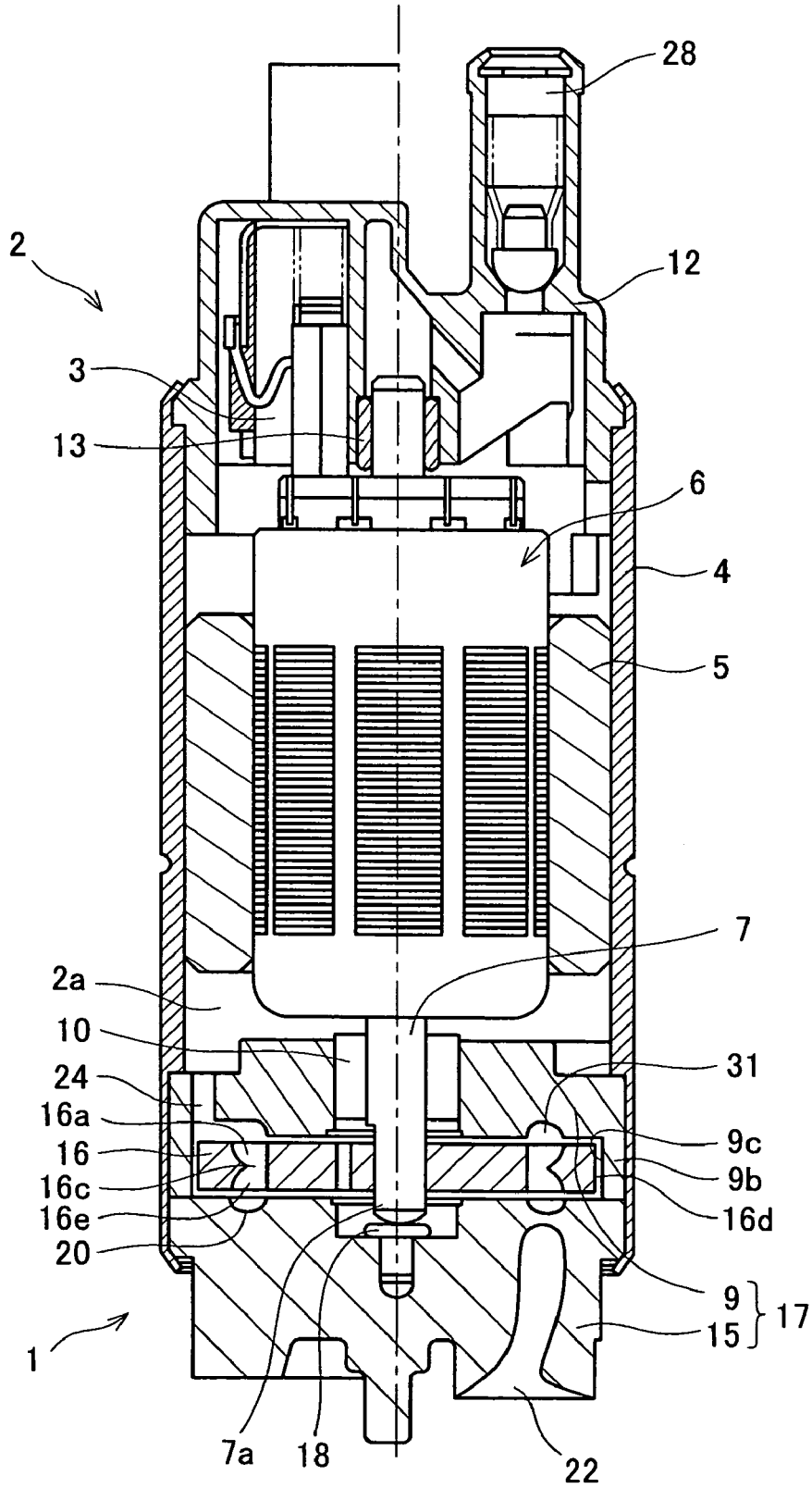
FIG. 1 shows a cross-sectional view of a fuel pump of a first embodiment.
Figure 2:
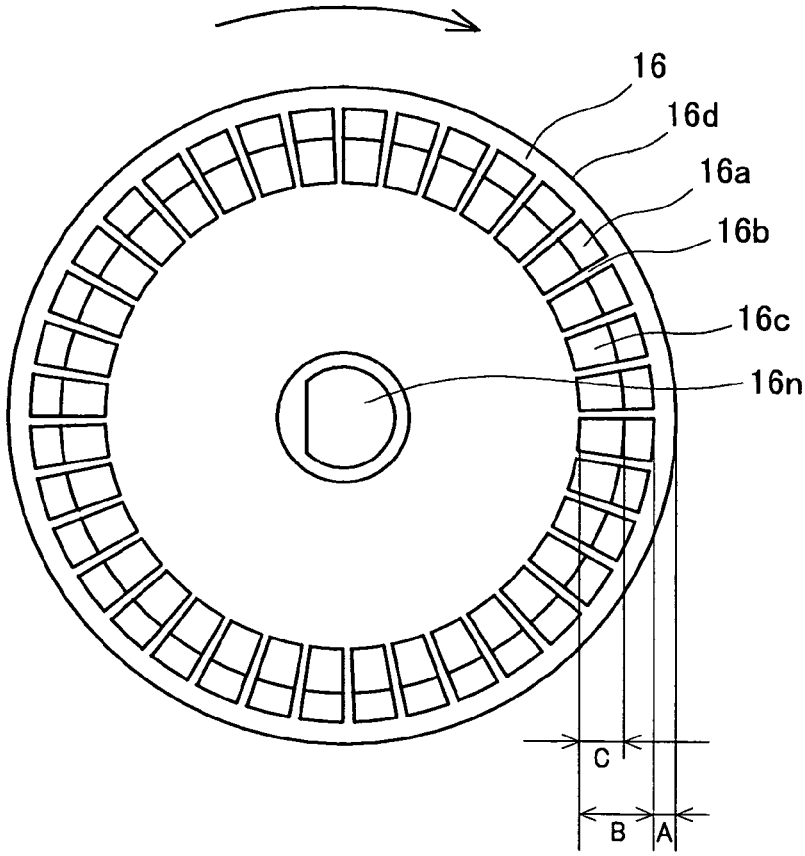
FIG. 2 shows a plane view of an upper face of an impeller of the fuel pump of the first embodiment.
Figure 3:
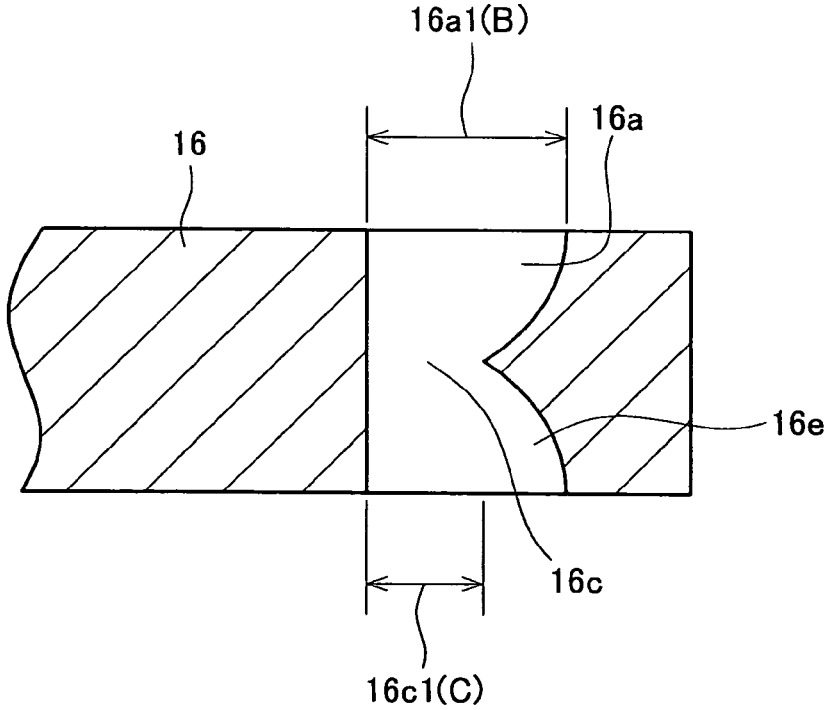
FIG. 3 shows an enlarged cross-sectional view showing essential part of the impeller of the first embodiment.
Figure 4:
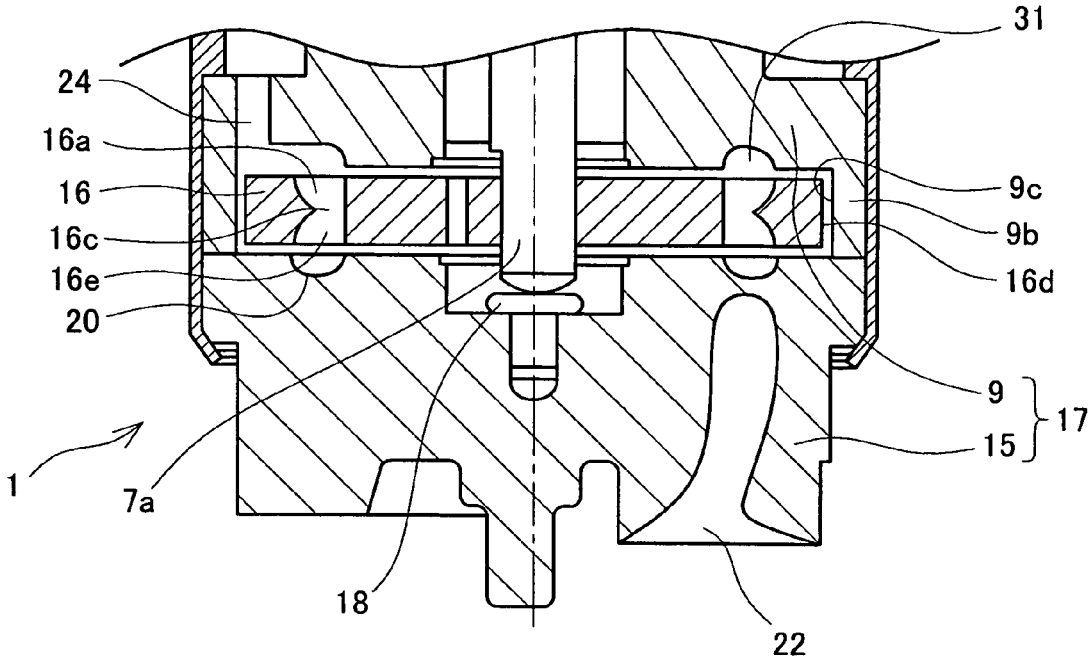
FIG. 4 shows a cross-sectional view showing essential part of the fuel pump of the first embodiment.

A first embodiment of the present invention is described referring to FIGS. 1 to 5. FIG. 1 shows a cross-sectional view of the fuel pump of the present embodiment, FIG. 2 shows a plane view of an upper face of an impeller of this fuel pump, FIG. 3 shows a cross-sectional view showing peripheral portion of the impeller, and FIG. 4 shows a cross-sectional view showing essential part of the fuel pump. Further, components that are identical in the conventional fuel pump and in the present embodiment have the same reference numbers assigned thereto.

The fuel pump of the present embodiment is used in a motor vehicle, the fuel pump being utilized within a fuel tank and being utilized for supplying fuel to the engine of the motor vehicle. As shown in FIG. 1, the fuel pump is composed of a pump section 1 and a motor section 2 for driving the pump section 1. The motor section 2 is provided with a brush 3, a magnet 5 located within an approximately cylindrical housing 4, and a rotating member 6 concentric with the magnet 5. The motor section 2 comprises a direct current motor.

A lower portion of a shaft 7 of the rotating member 6 is rotatably supported, via a bearing 10, on a pump cover 9 attached to a lower end portion of the housing 4. Furthermore, an upper end portion of the shaft 7 is rotatably supported, via a bearing 13, on a motor cover 12 attached to an upper end portion of the housing 4.

The rotating member 6 is caused to rotate by means of conductively connecting a coil (not shown) of the rotating member 6 via the brush 3 and a terminal (not shown) provided in the motor cover 12 to an electric source (not shown). The configuration of this type of motor section 2 is known in the art and a detailed description thereof is omitted. Further, a motor of a type differing from the type shown here may also be utilized.

The configuration of the pump section 1 that is driven by the motor section 2 is described next. The pump section 1 comprises the pump cover 9, a pump body 15, and an impeller 16, etc. The pump cover 9 and the pump body 15 are formed by, for example, die casting aluminum, and the two are fitted together to form a casing 17 wherein the impeller 16 is housed.

The impeller 16 is formed by means of resin molding. As shown in FIG. 2, the impeller 16 is substantially disc shaped. A group of concavities 16*a* is formed in an upper face of the impeller 16 in an area located inwardly from an impeller outer circumference face 16*d* by a first distance "A". The length of each concavity 16*a* in the radial direction is equal to a second distance "B". Adjacent concavities 16*a* are separated by a partitioning wall 16*b* that extends in the radial direction. The concavities 16*a* are repeated in the circumference direction. The group of concavities 16*a* extends along the circumference direction of the impeller 16. A group of concavities 16*e* is formed in a lower face of the impeller 16. The group of lower concavities 16*e* has the same configuration as of the group of upper concavities 16*a*. Bottom portions of the pair of upper concavities 16*a* and lower concavities 16*e* communicate via through-holes 16*c*.

As shown in FIGS. 2 and 3, each of through-holes 16*c* is formed at an inner side region within the pair of concavities 16*a*, 16*e* in the radial direction.

An approximately D-shaped fitting hole 16*n* is formed in the center of the impeller 16. A fitting shaft member 7*a*—this being D-shaped in cross-section—at the lower end portion of the shaft 7 fits into the fitting hole 16*n*. By this means, the impeller 16 is connected with the shaft 7 in a manner allowing follow-up rotation whereby slight movement in the axial direction is allowed. The outer circumference face 16*d* of the impeller 16 is a complete circular face without irregularities.

As shown in FIGS. 1 and 4, a groove 31 is formed in a lower face of the pump cover 9 in an area directly facing the group of concavities 16*a* in the upper face of the impeller 16, this groove 31 extending continuously in the direction of rotation of the impeller from an upper flow end to a lower flow end. A discharge hole 24 is formed in the pump cover 9, this discharge hole 24 extending from the lower flow end of the groove 31 to an upper face of the pump cover 9. The discharge hole 24 passes through from the interior to the exterior (an inner space 2*a* of the motor section 2) of the casing 17.

An inner circumference face 9*c* of a circumference wall 9*b* of the pump cover 9 faces, along the entire circumference of the pump cover 9, the impeller outer circumference face 16*d*, with a minute clearance therebetween. For the sake of clarity, the clearance is represented as larger in the figures than it is in reality.

The groove 31 of the pump cover 9, in the vicinity of the lower flow end thereof, gradually grows deeper as it approaches the discharge hole 24. The groove 31 faces the lower flow end and is displaced towards the outer side in the radial direction, but remains within the area of the impeller outer circumference face 16*d*. A terminal portion of the discharge hole 24 is formed in the outer side, relative to the radial direction, of the area facing the group of concavities 16*a* of the impeller 16.

As shown in FIGS. 1 and 4, a groove 20 is formed in an upper face of the pump body 15 in an area thereof directly facing the group of concavities 16*e* in the lower face of the impeller 16. The groove 20 extends continuously along the direction of rotation of the impeller from an upper flow end to a lower flow end. An intake hole 22 is formed in the pump body 15, the intake hole 22 extending from a lower face of the pump body 15 to the upper flow end of the groove 20. In a cross section not shown, the intake hole 22 and the groove 20 communicate. The intake hole 22 communicates between the exterior and interior of the casing 17. The groove 20, in the vicinity of the lower flow end thereof, gradually grows shallower as it approaches the lower flow end. Furthermore, the groove 20 remains within an area directly facing the group of concavities 16*e* in the lower face of the impeller 16.

The pump body 15, this being in a superposed state with the pump cover 9, is attached by means of caulking or the like to the lower end portion of the housing 4. A thrust bearing 18 is fixed to a central portion of the pump body 15. The thrust load of the shaft 7 is received by the thrust bearing 18.

In FIG. 4, for the sake of clarity, each clearance is represented as larger than it is in reality. The groove 20 of the pump body 15 does not communicate directly with the discharge hole 24. The circumference wall 9*b* of the pump cover 9 is adjacent to the impeller outer circumference face 16*d* even at the location of the discharge hole 24, and the groove 20 and the discharge hole 24 do not actually communicate at the outer side of the impeller outer circumference face 16*d*. The groove 20 and the discharge hole 24 communicate only by means of the through-holes 16*c* of the impeller 16.

The groove 31 extending in the circumference direction of the pump cover 9, and the groove 20 extending in the circumference direction of the pump body 15 extend along the direction of rotation of the impeller 16, and extend from the intake hole 22 to the discharge hole 24. When the impeller 16 rotates, the fuel within the fuel tank is drawn into the casing 17 from the intake hole 22. A portion of the fuel taken into the casing 17 from the intake hole 22 flows along the groove 20. The remaining portion of the fuel taken into the casing 17 from the intake hole 22 enters the concavities 16*e* of the impeller 16, passes through the through-holes 16*c* while a revolving current of this fuel is being caused to occur within these concavities 16*e*, enters the groove 31, and flows along the groove 31. The pressure of the fuel rises as it flows along the grooves 20 and 31. The fuel that has flowed along the groove 31 and been pressurized is delivered from the discharge hole 24 to the motor section 2. The fuel that has flowed along the groove 20 and has been pressurized passes through the through-holes 16*c* of the impeller 16 and merges with the fuel that was pressurized in the groove 31. After merging, the fuel is delivered from the discharge hole 24 to the motor section 2. The highly pressurized fuel delivered to the motor section 2 is delivered to the exterior of the pump from a discharge port 28.

It is desirable that the length of the through-holes 16*c* (16*c*1: see FIG. 3) in the radial direction is between one quarter to three quarters of the length of the concavities 16*a*, 16*e* (16*a*1: see FIG. 3) in the radial direction. This size has been reached through the research of the inventors. If the through-holes 16*c* are formed in this size, the revolving currents of fuel are readily formed within the concavities 16*a*, 16*e* and the fuel readily passes smoothly through the through-holes 16*c*.

The space between the discharge hole 24 and the intake hole 22, along the direction of rotation of the impeller 16, does not have the grooves 31 and 20 formed therein. The groove 26 of the pump body 15 gradually grows shallower and closes as it approaches the lower flow end. Consequently, the fuel flowing along the groove 20 is easily forced into the through-holes 16*c* of the impeller 16. Further, the groove 31 of the pump cover 9 gradually grows deeper as it approaches the lower flow end, and passes through to the discharge hole 24. Consequently, the pressurized fuel is smoothly discharged from the discharge hole 24, and the operating noise of the pump is rendered quieter. The clearance between the impeller outer circumference face 16*d* and the pump cover inner circumference face 9*c* is extremely small along its entire circumference. Consequently, the pressurized fuel does not enter this clearance, and instead passes through the through-holes 16*c* of the impeller 16.

In the fuel pump of the present embodiment, access to the discharge hole 24 is obtained by means of the through-holes 16*c* that communicate between the pair of upper concavities 16*a* and lower concavities 16*e* of the impeller 16. These through-holes 16*c* are formed at the inner side region within the concavities 16*a*, 16*e*. The rotational speed of the impeller 16 at the through-holes 16*c* is slower than in the case where the through-holes 16*c* are formed at the outer side region within the concavities 16*a*, 16*e*. As a result, the revolving speed of the fuel in the vicinity of the through-holes 16*c* between the upper concavities 16*a* and lower concavities 16*e* is lower, and the fuel easily passes through the through-holes 16*c*. The fuel drawn into the casing 17 smoothly enters into the upper concavities 16*a* and the groove 31 through the lower concavities 16*e* and the thorough-hole 16*c* in the vicinity of the intake hole 22. The fuel pressurized in the lower cavities 16*e* and the groove 20 smoothly enters into the groove 31 through the thorough-hole 16*c* in the vicinity of the discharge hole 24. Since the fuel passes smoothly through the through-holes 16*c*, the quantity of vapor formed within the fuel pump can be reduced, allowing pump efficiency to rise. Performance of the fuel pump can thus be stabilized even at high temperatures.

Figure 5:
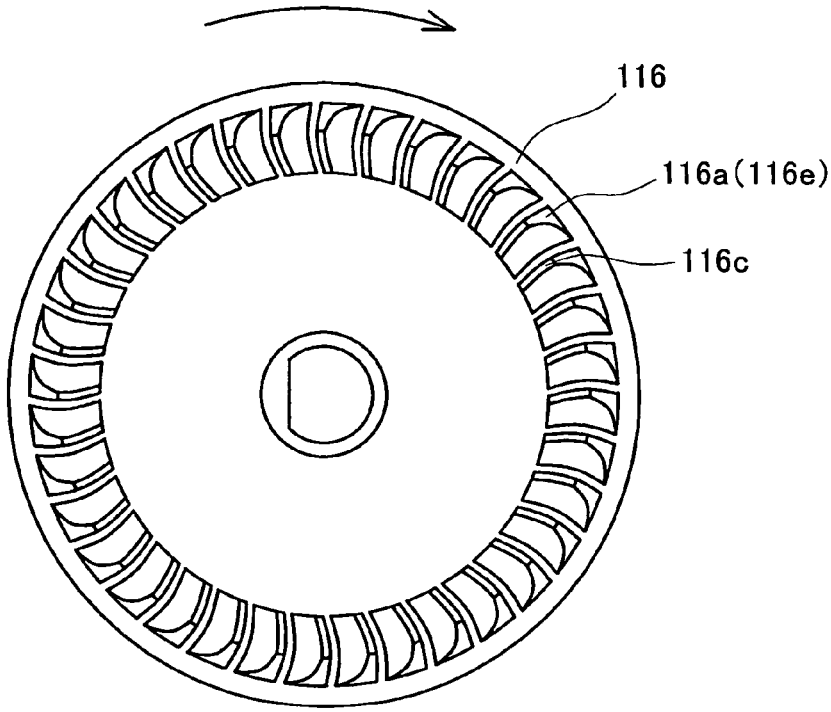
FIG. 5 shows a plan view of an upper face of a modified impeller.

Moreover, an modified embodiment is also possible wherein the openings of the concavities formed in the upper and lower faces of the impeller have the shape shown in FIG. 5 instead of the shape shown in FIG. 2. Like the impeller 16 shown in FIG. 2, when through-holes 116*c* communicating the upper concavities 116*a* and lower concavities 116*e* are formed at inner side region of the concavities 116*a*, 116*e*, the results described above can be obtained. In the concavities 116*a*, 116*e* shown in FIG. 5, opening edges that extend in the radial direction are curved. Forming the concavities 116*a*, 116*e* in this shape allows the fuel to enter the cavities 116*a*, 116*e* readily therein, thereby further increasing pump efficiency. The shape of the openings of the concavities 116*a*, 116*e* can also be utilized in the second to fourth embodiments described below.

Figure 6:
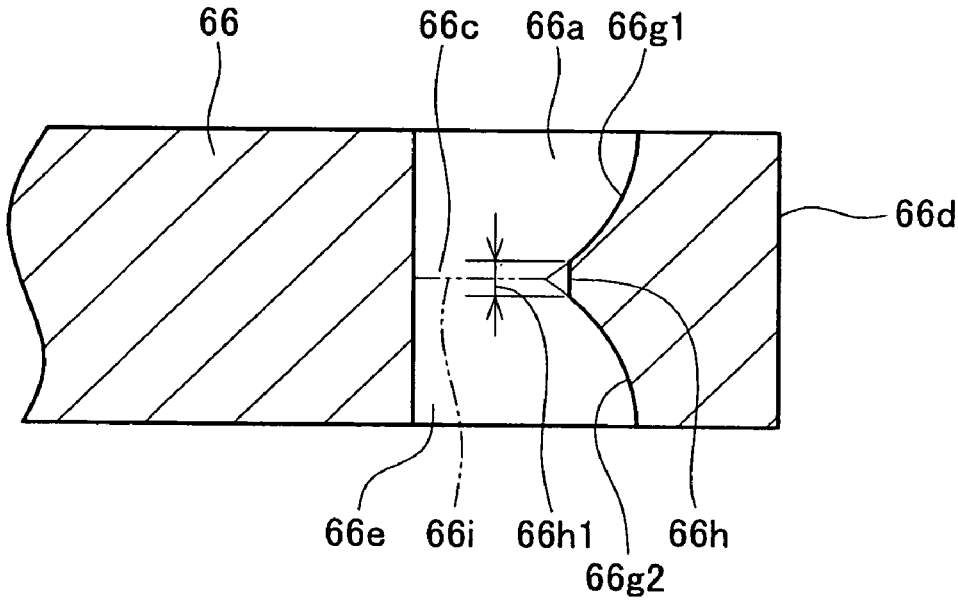
FIG. 6 shows an enlarged cross-sectional view showing essential part of an impeller of a second embodiment.

A second embodiment of the present invention is described refereeing to FIG. 6. The fuel pump of the second embodiment has a configuration approximately identical with that of the fuel pump of the first embodiment; only the shape of the impeller differs. Consequently, only the points differing from the first embodiment are described here, and a description of identical components is omitted.

FIG. 6 shows an enlarged cross sectional view of the impeller in the second embodiment. A group of concavities 66*a* is formed in an upper face of the impeller 66, and a group of concavities 66*e* is formed in an lower face of the impeller 66 as shown in FIG. 6. Bottom portions of the pair of upper concavities 66*a* and lower concavities 66*e* communicate via through-holes 66*c*. Each of the through-holes 66*c* is formed within a region at the inner side of each of concavities 66*a*, 66*e*. The bottom portions of the upper and lower concavities 66*a*, 66*e* are separated by a partitioning member 66*h*. The partitioning member 66*h* is formed from a wall 66*g*1 at the outer side of the upper concavity 66*a* and a wall 66*g*2 at the outer side of the lower concavity 16*e*, and is formed at a central portion of the impeller 66 relative to the direction of thickness thereof. The wall faces 66*g*1 and 66*g*2 located at the outer side of the concavities 66*a*, 66*e* are curved, and extend towards the bottom portions to make contact with a plane 66*i* that bisects the thickness 66*h*1 of the partitioning member 66*h*. The plane 66*i* that bisects the thickness **66*h*1 of the partitioning member 66*h* is identical with a plane that bisects the impeller 66 in its thickness. The partitioning member 66*h* causes the wall faces 66*g*1 and 66*g*2 to extend towards the bottom portions, and the end portion thereof has a truncated shape. An end face of the partitioning member 66*h* is flat and forms a wall face of the through-hole 66*c***.

Revolving currents of fuel that are formed within the upper and lower concavities **66*a*, 66*e* merge at the through-holes 66*c*. By forming the partitioning member 66*h* within the concavities 66*a*, as described above, the fuel flows along the curved wall faces 66*g*1 and 66*g*2. Consequently, the upper and lower revolving currents of fuel do not collide at the through-holes 66*c* between the concavities 66*a*, 66*e* but instead are parallel. By this means, it is possible to reduce agitation of the currents and the loss of energy caused by the currents of fuel colliding at the through-holes 66*c*. Since the fuel can pass smoothly through the through-holes 66*c***, the quantity of vapor formed within the fuel pump can be reduced, and pump efficiency can be increased. Performance of the fuel pump can thus be stabilized even at high temperatures.

If the wall faces **66*g*1 and 66*g*2 of the upper and lower concavities 66*a*, 66*e* are formed such that they make direct contact with the plane 66*i* that bisects the thickness 66*h*1 of the partitioning member 66*h*, the partitioning member 66*h* takes on a thin shape towards the bottom portions, without any limit on the degree of thinness. However, if the partitioning member 66*h* is formed in this manner, there is the danger that the thin portion of the partitioning member 66*h* at the bottom portions may be of uncertain strength and may change its shape, thereby preventing rather than facilitating the smooth revolving of the fuel currents. However if, as in the present embodiment, the inner wall faces 66*g*1 and 66*g*2 are not caused to extend as far as the plane 66*i*, the upper and lower parallel currents of fuel at the through-holes 66*c* between the concavities 66*a*, 66*e* are not obstructed in spite of the end face being formed in the partitioning member 66*h*. The strength of the wall faces can be maintained, and the necessary size of the through-holes 66*c* can also be maintained. If anything, the fuel passes more easily through the through-holes 66*c***.

Figure 7:
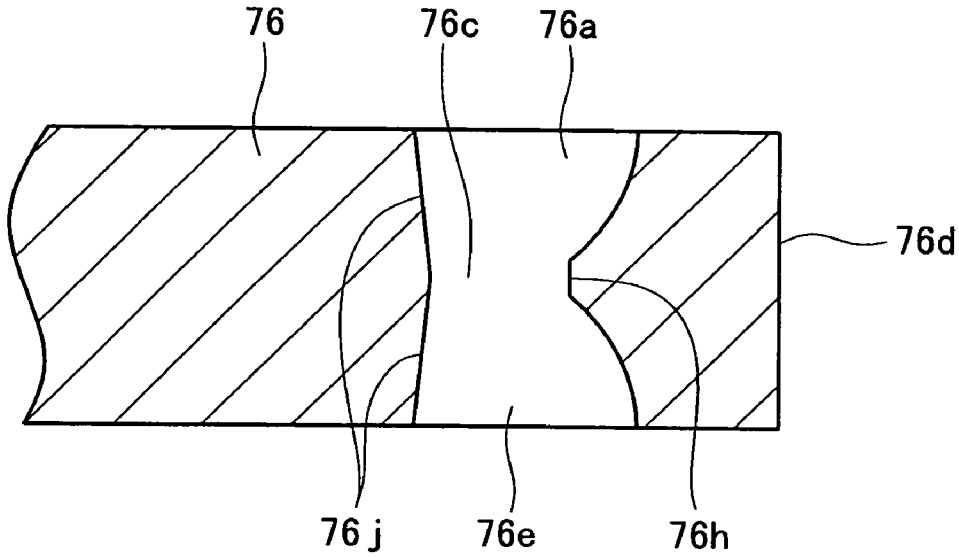
FIG. 7 shows an enlarged cross-sectional view showing essential part of an impeller of a third embodiment.

A third embodiment of the invention is described referring to FIG. 7. The fuel pump of the embodiment has a configuration approximately identical with that of the fuel pump of the first embodiment; only the shape of the impeller differs. Consequently, only the points differing from the first embodiment are described here, and a description of identical components is omitted.

FIG. 7 shows an enlarged cross sectional view of an impeller of the third embodiment. A groups of concavities **76*a* is formed in an upper face of an impeller 76 and a groups of concavities 76*e* is formed in an lower as shown in FIG. 7. Bottom portions of the pair of upper and lower concavities 76*a*, 76*e* communicate via a through-hole 76*c*. Each of the through-holes 76*c* is formed at the inner side of each of the concavities 76*a*, 76*e*. The bottom portions of the upper and lower concavities 76*a*, 76*e* are partitioned by a partitioning member 76*h***.

Inclined faces **76*j* are formed at the inner sides of the upper and lower concavities 76*a*, 76*e* formed in the impeller 76. These inclined faces 76*j* are inclined outwardly in the radial direction towards the bottom. The impeller 76 of the fuel pump of the present embodiment differs in this point from the impeller 66** of the fuel pump of the second embodiment.

The impeller 76 is formed by a resin which is molded within a molding die and extracted from the die. By forming the concavities **76*a*, 76*e* in the manner described above, the inclined faces 76*j* formed in the walls of the concavities 76*a* can be utilized as slopes aiding in extraction from the molding die. The production efficiency of molding the concavities 76*a* is improved while the currents of fuel are simultaneously caused to revolve smoothly. Since the fuel can pass smoothly through the through-holes 76*c***, the quantity of vapor formed within the fuel pump can be reduced, and pump efficiency can be increased. Performance of the fuel pump can thus be stabilized even at high temperatures.

Figure 8:
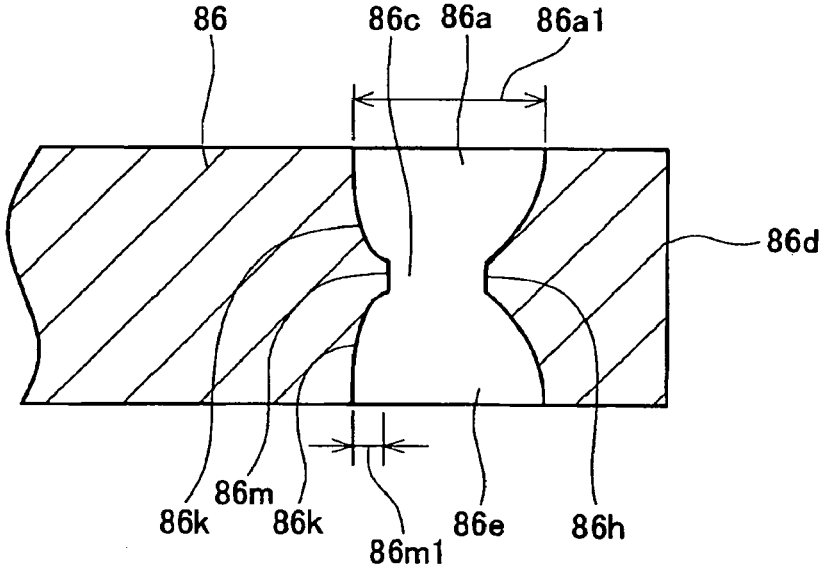
FIG. 8 shows an enlarged cross-sectional view showing essential part of an impeller of a fourth embodiment.
Figure 9:
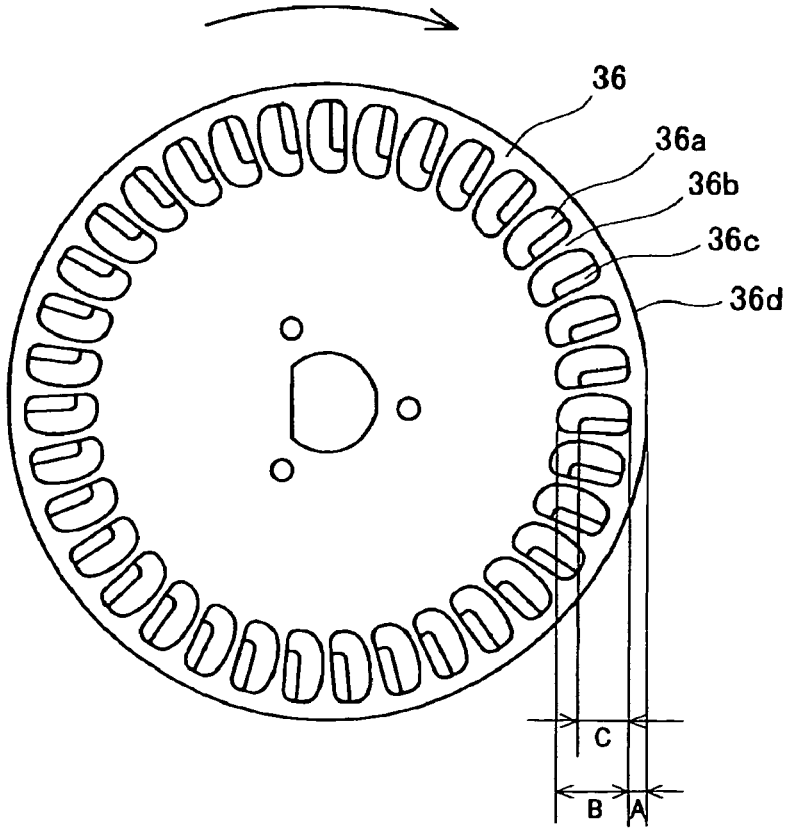
FIG. 9 PRIOR ART
FIG. 9 shows a plane view of an upper face of an impeller of a conventional fuel pump.
Figure 10:
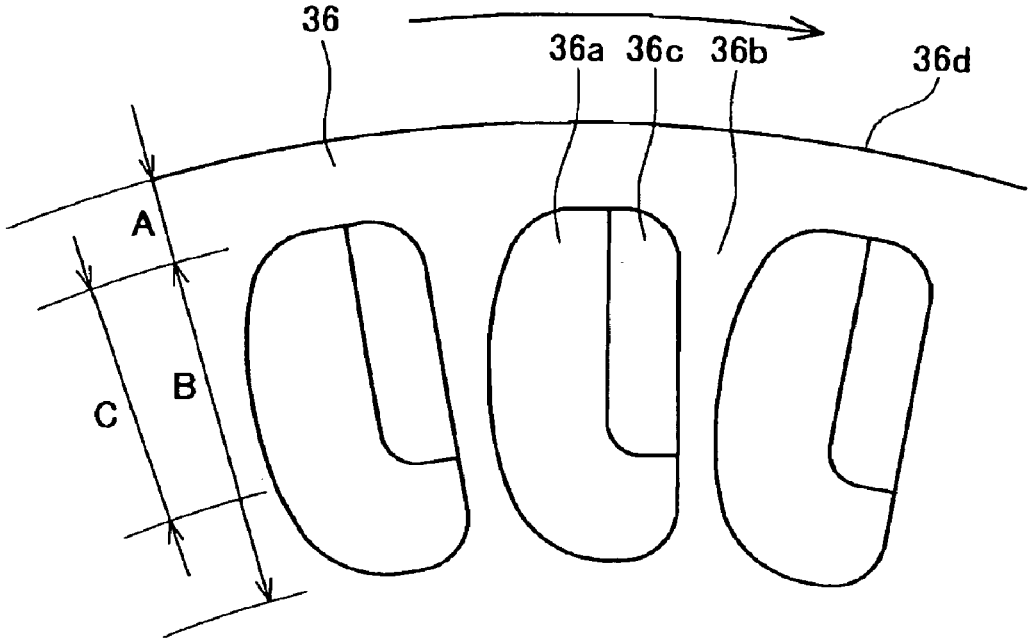
FIG. 10 PRIOR ART
FIG. 10 shows an enlarged view showing essential part of the upper face of the conventional impeller.
Figure 11:
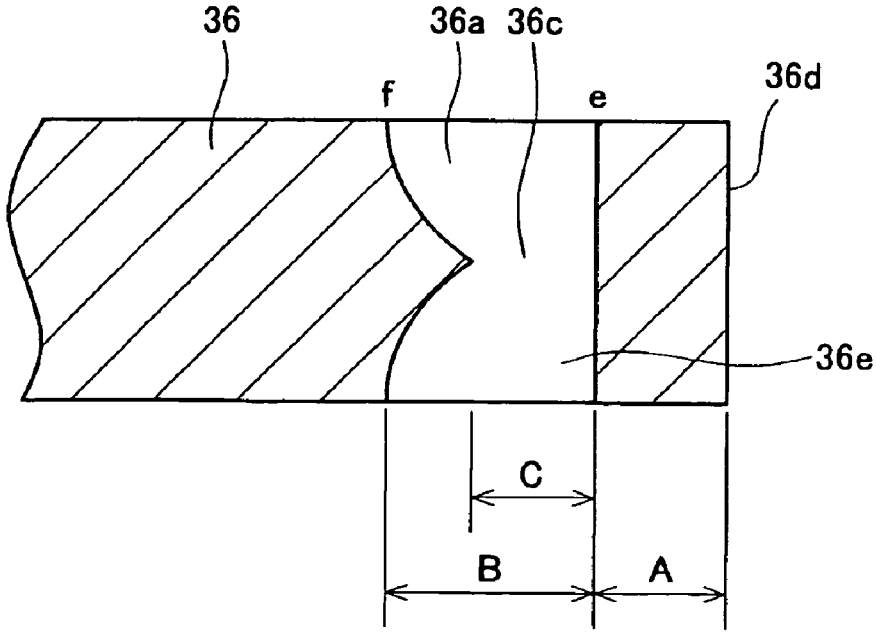
FIG. 11 PRIOR ART
FIG. 11 shows an enlarged cross-sectional view showing essential part of the conventional impeller.
Figure 12:
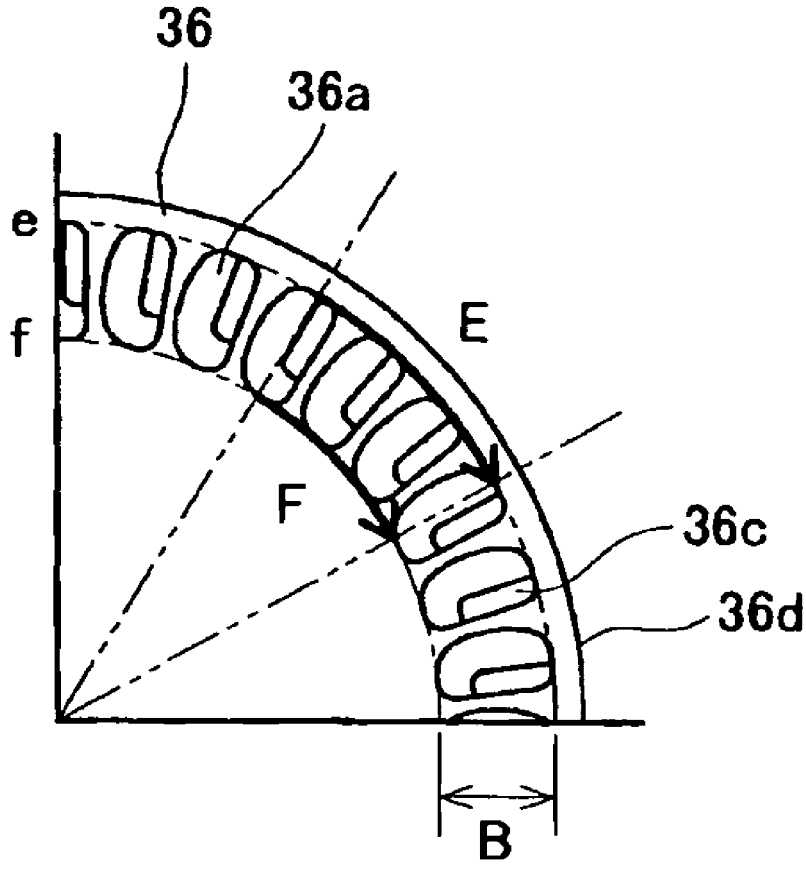
FIG. 12 PRIOR ART
FIG. 12 shows a plane view showing essential part of the upper face of the conventional impeller.

A fourth embodiment of the present invention is described referring to FIG. 8. FIG. 8 shows an enlarged cross sectional view of an impeller of the fourth embodiment. A group of concavities **86*a* is formed in an upper face and a group of concavities 86*e* is formed in an lower face of an impeller 86 as shown in FIG. 8. Bottom portions of the pair of upper and lower concavities 86*a*, 86*e* communicate via a through-hole 86*c*. Each of the through-holes 86*c*** is formed at the inner side within each of the concavities.

Curved faces **86*k* are formed at inner sides of the upper and lower concavities 86*a*, 86*e* formed in the impeller 86. These curved faces 86*k* are translated outwardly towards the bottom portions. Further, a protruding member 86*m* is formed on the inner wall between the upper and lower concavities 86*a*, 86*e*. Faces of each curved face 86*k* that extend towards the bottom portions form a face (not shown) that bisect the thickness of the protruding member 86*m*, the face being identical with a plane bisecting the thickness of the partitioning member 86*h*. The impeller 86 of the fuel pump of the present embodiment differs in this point from the impeller 66** of the fuel pump of the second embodiment.

The outer side walls of the concavities **86*a*, 86*e* and the inner side walls 86*k* of the concavities 86*a*, 86*e* are all curved faces. Since angular portions are not formed in the bottom portions of the concavities 86*a*, 86*e*, the revolving currents of fuel are not obstructed. In the present embodiment, the revolving currents of fuel are smoother. Since the fuel can pass smoothly through the through-holes 86*c***, the quantity of vapor formed within the fuel pump can be reduced, and pump efficiency can be increased. Performance can thus be stabilized even at high temperatures.

Moreover, it is desirable for the length **86*m*1 of the protruding member 86*m* in the radial direction to be one eighth or less of the length 86*a*1 of each concavity 86*a*, 86*e* in the radial direction. This size has been derived through the research of the inventors. If the protruding members 86*m* are formed in this size, the revolving currents of fuel are readily formed within the concavities 86*a*, 86*e* and the fuel easily passes smoothly through the through-holes 86*c***.

Specific examples of embodiments of the present invention are presented above, but these merely illustrate some possibilities of the invention and do not restrict the claims thereof. The art set forth in the claims includes various transformations and modifications to the specific examples set forth above.

Furthermore, the technical elements disclosed in the present specification or figures may be utilized separately or in all types of conjunctions and are not limited to the conjunctions set forth in the claims at the time of submission of the application. Furthermore, the art disclosed in the present specification or figures may be utilized to simultaneously realize a plurality of aims or to realize one of these aims.

The invention claimed is:

1. A fuel pump, comprising a casing and a substantially disc-shaped impeller rotating within the casing; wherein a group of concavities is formed in both upper and lower faces of the impeller in an area located inwardly from an outer circumference of the impeller by a first distance, the area extending along the circumferential direction of the impeller, a groove is formed in both upper and lower inner faces of the casing in an area directly facing the group of the concavities, each concavity extends for a second distance in the radial direction of the impeller from an inner end to an outer end, adjacent concavities are separated by a partitioning wall, the pair of upper and lower concavities are partially separated by a partitioning wall, and bottom portions of the pair of upper and lower concavities are connected over a region extending outwardly from a point which is separated from the inner end of the concavities by a distance not exceeding one eighth of the second distance at the concavities whose inner ends directly face and align with an inner end of the groove formed in the casing and whose outer ends directly face and align with an outer end of the groove formed in the casing.

2. A fuel pump as set forth in claim 1, wherein the bottom portions of the pair of upper and lower concavities do not communicate at an outer side region within the concavities.

3. A fuel pump as set forth in claim 1, wherein the bottom portions of the pair of upper and lower concavities are connected along a third distance in the radial direction of the impeller, and the third distance is set to be between one quarter to three quarters of the second distance.

4. A fuel pump as set forth in claim 1, wherein wall faces at the outer sides of the pair of upper and lower concavities extend, when viewed cross-sectionally along the radial direction of the impeller, along curved lines making contact with a central line bisecting the impeller in the direction of thickness thereof.

5. A fuel pump as set forth in claim 1, wherein wall faces at the inner sides of the pair of upper and lower concavities extend, when viewed cross-sectionally along the radial direction of the impeller, incline outwardly towards the bottom portions of the concavities.

6. A fuel pump as set forth in claim 1, wherein wall faces at the inner sides of the pair of upper and lower concavities are curved inclining outwardly towards the bottom portions of the concavities when viewed cross-sectionally along the radial direction of the impeller.

* * * * *